US010323814B2

(12) United States Patent
Yagi et al.

(10) Patent No.: US 10,323,814 B2
(45) Date of Patent: Jun. 18, 2019

(54) VEHICULAR LAMP HAVING A TWO-DIMENSIONAL IMAGE FORMING DEVICE AND A DIMMING PART

(71) Applicant: KOITO MANUFACTURING CO., LTD., Tokyo (JP)

(72) Inventors: Takayuki Yagi, Shizuoka (JP); Satoshi Yamamura, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 1176 days.

(21) Appl. No.: 14/018,793

(22) Filed: Sep. 5, 2013

(65) Prior Publication Data

US 2014/0071706 A1 Mar. 13, 2014

(30) Foreign Application Priority Data

Sep. 7, 2012 (JP) ..... 2012-197277

(51) Int. Cl.

| | |
|---|---|
| ***F21S 41/00*** | (2018.01) |
| ***F21S 41/25*** | (2018.01) |
| ***F21S 41/143*** | (2018.01) |
| ***F21S 41/43*** | (2018.01) |
| ***F21S 41/64*** | (2018.01) |

(Continued)

(52) U.S. Cl.

CPC ..... *F21S 41/25* (2018.01); *F21S 41/135* (2018.01); *F21S 41/143* (2018.01); *F21S 41/285* (2018.01); *F21S 41/365* (2018.01); *F21S 41/43* (2018.01); *F21S 41/645* (2018.01); *F21S 41/675* (2018.01)

(58) Field of Classification Search

CPC ..... F21Y 2105/001; F21S 48/1154; F21S 48/115; F21S 48/125; F21S 48/1388

USPC ..... 362/459

See application file for complete search history.

(56) References Cited

U.S. PATENT DOCUMENTS

| | | | |
|---|---|---|---|
| 5,938,319 | A | 8/1999 | Hege |
| 2002/0054275 | A1 | 5/2002 | Yamanaka |

(Continued)

FOREIGN PATENT DOCUMENTS

| | | | |
|---|---|---|---|
| CN | 101210660 | A | 7/2008 |
| CN | 101275730 | A | 10/2008 |

(Continued)

OTHER PUBLICATIONS

Office Action in counterpart Japanese Patent Application No. 2012-197277, dated May 31, 2016 (9 pages).

(Continued)

*Primary Examiner* — Gerald J Sufleta, II
(74) *Attorney, Agent, or Firm* — Osha Liang LLP

(57) ABSTRACT

A vehicular lamp includes a projection lens, a two-dimensional image forming device located on or in the vicinity of a rear focal point of the projection lens, and including a plurality optical elements which are arranged in a matrix shape and individually driven and a projection plane that is formed by the plurality optical elements, a light source configured to irradiate the projection plane of the two-dimensional image forming device with light, and a dimming part provided between the optical elements and the projection lens and configured to reduce light directed to the projection lens from the optical elements arranged on an end portion of the projection plane.

4 Claims, 8 Drawing Sheets

(51) Int. Cl.

| | |
|---|---|
| ***F21S 41/675*** | (2018.01) |
| ***F21S 41/365*** | (2018.01) |
| ***F21S 41/135*** | (2018.01) |
| ***F21S 41/20*** | (2018.01) |

(56) References Cited

U.S. PATENT DOCUMENTS

| | | | | |
|---|---|---|---|---|
| 2005/0237628 | A1 | 10/2005 | Shimizu | |
| 2008/0043481 | A1* | 2/2008 | Yokoyama et al. | 362/465 |
| 2008/0158892 | A1* | 7/2008 | Davis | G02B 5/003 362/362 |
| 2008/0198372 | A1* | 8/2008 | Pan | B60Q 1/38 356/121 |
| 2008/0239744 | A1* | 10/2008 | Nakada | B60Q 1/0041 362/516 |
| 2009/0046474 | A1* | 2/2009 | Sato | B60Q 1/076 362/466 |
| 2011/0063864 | A1* | 3/2011 | Brown et al. | 362/509 |
| 2012/0033287 | A1* | 2/2012 | Friedman | C03C 17/34 359/275 |
| 2013/0027962 | A1* | 1/2013 | Takahashi | F21S 48/1145 362/538 |
| 2013/0107559 | A1* | 5/2013 | Gava | F21S 48/1731 362/516 |

FOREIGN PATENT DOCUMENTS

| | | | |
|---|---|---|---|
| DE | 19822142 | A1 | 11/1999 |
| DE | 20316660 | U1 | 12/2003 |
| DE | 10330215 | A1 | 1/2005 |
| EP | 2275735 | A1 | 1/2011 |
| JP | H06-191346 | A | 7/1994 |
| JP | 9-104288 | A | 4/1997 |
| JP | 2002148710 | A | 5/2002 |
| JP | 2005309337 | A | 11/2005 |
| KR | 20110084785 | A | 7/2011 |

OTHER PUBLICATIONS

Office Action issued in corresponding Chinese Application No. 201310400383.7, dated Apr. 29, 2015 (15 pages).
Search Report issued in European Application No. 13183266.9, dated Feb. 28, 2018 (7 pages).

* cited by examiner

VEHICULAR LAMP HAVING A TWO-DIMENSIONAL IMAGE FORMING DEVICE AND A DIMMING PART

CROSS-REFERENCE TO RELATED APPLICATION(S)

The present application claims the benefit of priority of Japanese Patent Application No. 2012-197277 filed on Sep. 7, 2012. The disclosures of the application are incorporated herein by reference.

BACKGROUND

Technical Field

The present disclosure relates to a vehicular lamp to be mounted on a vehicle.

Related Art

A lighting device using a DMD (Digital Mirror Device) which includes several hundreds to hundred thousands of tiny reflective elements is disclosed in Patent Document 1. Patent Document 1 has suggested that the characteristics of the light beam emitted from the lighting device are extensively changed by each reflective element of the DMD in a simple manner.

Patent Document 1: Japanese Patent Laid-Open Publication No. Hei 9-104288

However, light from a light source is irradiated toward a projection plane on DMD while being spread to some extent. Out of light from the light source, light incident on the projection plane side in a boundary of the projection plane is reflected and projected to the front of the lamp by a projection lens. Meanwhile, light directed to the outside of the projection plane is not reflected and is not incident on the projection lens. Accordingly, in the light distribution pattern projected to the front of the lamp by the projection lens, a clear boundary line between a dark portion and a bright portion due to a boundary of the projection plane is formed and therefore a user feels a sense of discomfort.

SUMMARY

Exemplary embodiments of the invention provide a vehicular lamp which is capable of obscuring a boundary line between a bright portion and a dark portion due to a boundary of the projection plane and capable of forming a natural light distribution pattern without giving a sense of discomfort.

A vehicular lamp according to an exemplary embodiment of the invention, comprises:

- a projection lens;
- a two-dimensional image forming device located on or in the vicinity of a rear focal point of the projection lens, and including a plurality optical elements which are arranged in a matrix shape and individually driven and a projection plane that is formed by the plurality optical elements;
- a light source configured to irradiate the projection plane of the two-dimensional image forming device with light; and
- a dimming part provided between the optical elements and the projection lens and configured to reduce light directed to the projection lens from the optical elements arranged on an end portion of the projection plane.

The vehicular lamp may comprise a transparent cover provided between the optical elements and the projection lens, wherein the dimming part is provided in an end portion of the transparent cover.

The dimming part may gradually reduce the light directed to the projection lens over the optical elements arranged from the central side to the end portion side of the projection plane.

The dimming part may reduce light directed to the projection lens by blocking a portion of light directed to the projection lens from the optical elements.

The dimming part may reduce light directed to the projection lens by diffusing a portion of light directed to the projection lens from the optical elements.

According to the present invention, since the dimming part is provided so as to correspond to the end portion of the projection plane in a two-dimensional image forming device, it is possible to reduce an amount of light to be incident on the projection lens from the reflective elements arranged on the end portion and it is possible to reduce a unnatural brightness difference of the light distribution pattern occurring due to a boundary of the projection plane. In this way, it is possible to provide a vehicular lamp which is capable of forming a light distribution pattern having a natural visual performance.

DETAILED DESCRIPTION

Hereinafter, an example of a vehicular lamp according to an exemplary embodiment of the present invention will be described with reference to the accompanying drawings.

Figure 1:
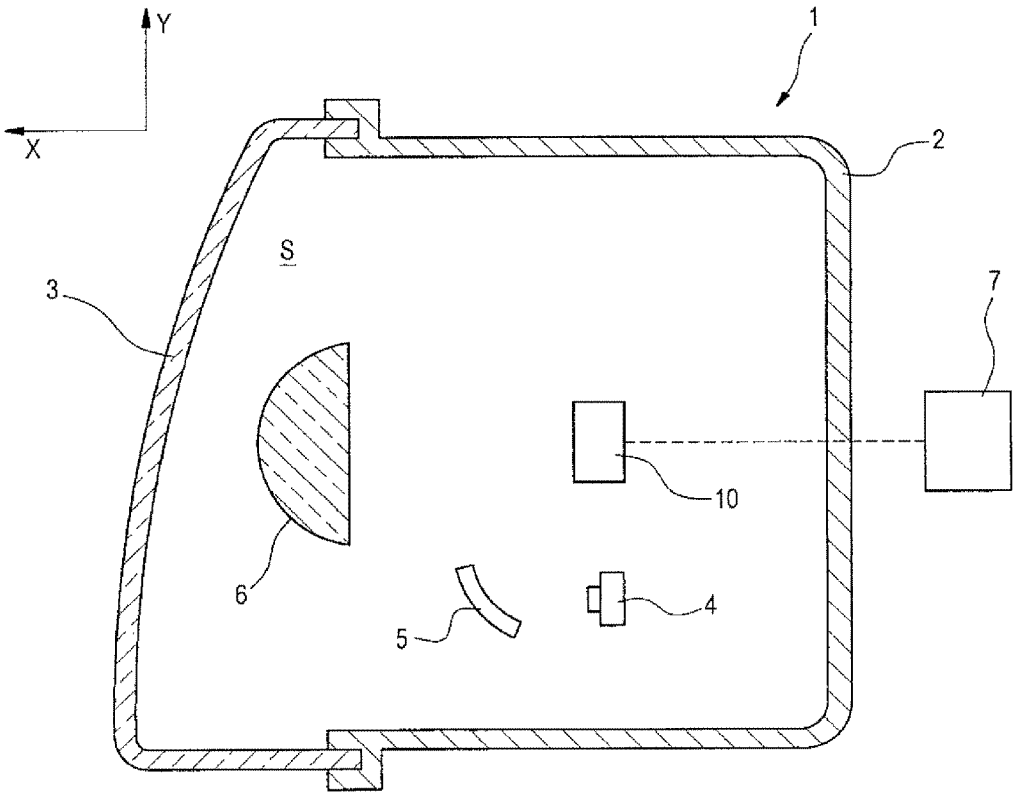
FIG. 1 is a sectional side view of a vehicular headlamp according to an exemplary embodiment of the present invention.

FIG. 1 shows a sectional side view of a vehicular headlamp 1 that is an example of a vehicular lamp. The vehicular headlamp 1 includes a lamp body 2 having an opening that opens to the front of the lamp and an outer cover 3 made of transparent resin and attached to the opening. The outer cover 3 is disposed to close the opening of the lamp body 2 from the front and forms a lamp chamber S together with the lamp body 2. In the following description, a direction of an arrow X shown in FIG. 1 is defined as a front side that is a light irradiation direction and a direction of an arrow Y shown in FIG. 1 is defined as an upper side.

In the interior of the lamp chamber S, a DMD (Digital Mirror Device) 10 as a two-dimensional image forming device, a LED 4 as a light source, a reflector 5 for reflecting light from the LED 4 toward the DMD 10 and a projection lens 6 through which light from the DMD 10 is transmitted to the front are provided. Further, in the outside of the chamber S, a control unit 7 for controlling an operation of the DMD 10 is provided.

Figure 2:
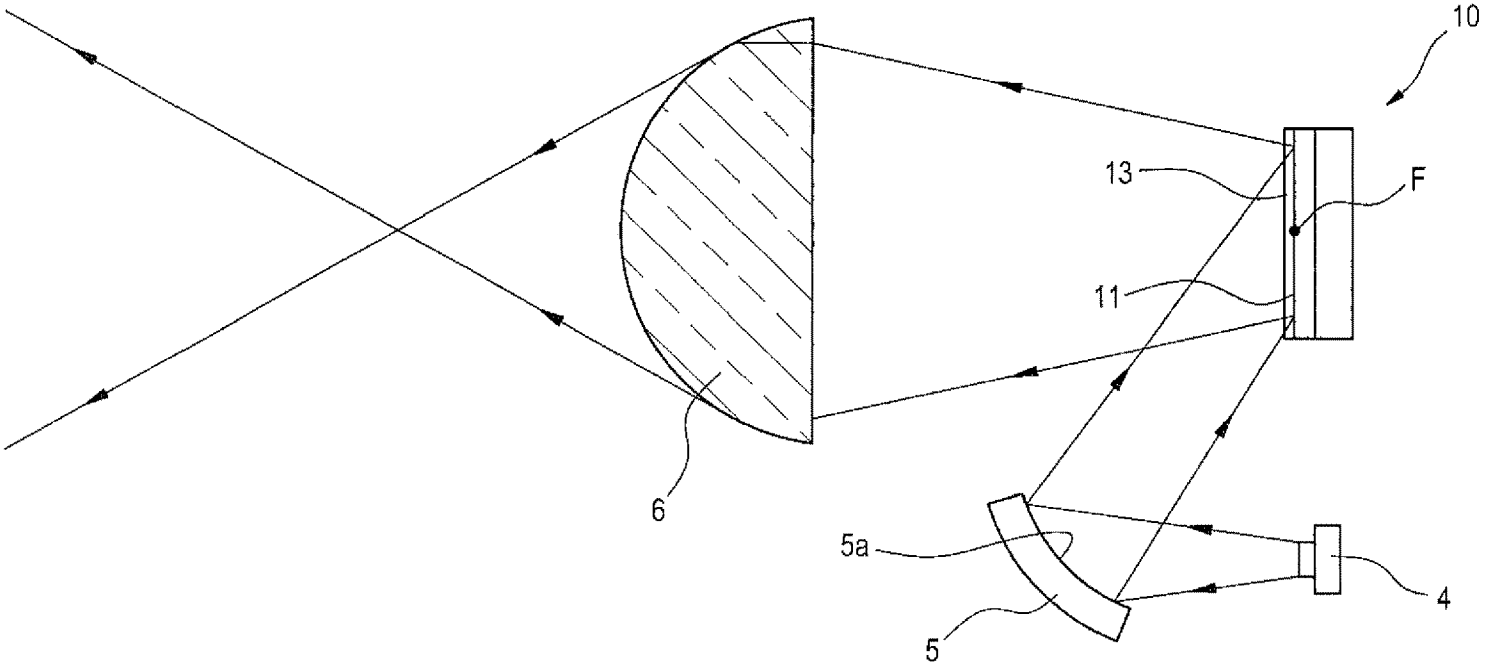
FIG. 2 is a partially enlarged view of FIG. 1.

FIG. 2 is an enlarged view showing each member disposed in the interior of the lamp chamber S.

A projection plane 11 for reflecting light from the LED 4 is formed on a front side surface of the DMD 10. The reflector 5 includes a reflective surface 5*a* for reflecting the light emitted from the LED 4 toward the projection plane 11 of the DMD 10. Substantially entire surface of the projection plane 11 of the DMD 10 is irradiated with the light that is emitted from the LED 4 and reflected by the reflector 5.

The projection lens 6 is provided in such a way that an optical axis Ax (FIG. 3) thereof is directed to a front-rear direction of the lamp. The projection lens 6 is disposed on the front side of the DMD 10 so that a position of a rear focal point F of the projection lens 6 substantially coincides with the projection plane 11 of the DMD 10. Thereby, an irradiation pattern formed on the projection plane 11 of the DMD 10 is projected forward in a state of being vertically and horizontally inverted and enlarged.

A transparent cover 13 is provided between the projection plane 11 of the DMD 10 and the projection lens 6 and, in the present embodiment, on the projection plane 11 of the DMD 10. The transparent cover 13 is a member for protecting reflective elements 12 to be described later. The transparent cover 13 is disposed to cover the projection plane 11. Accordingly, the light reflected by the projection plane 11 is emitted to the front of the lamp through the transparent cover 13.

Figure 3:
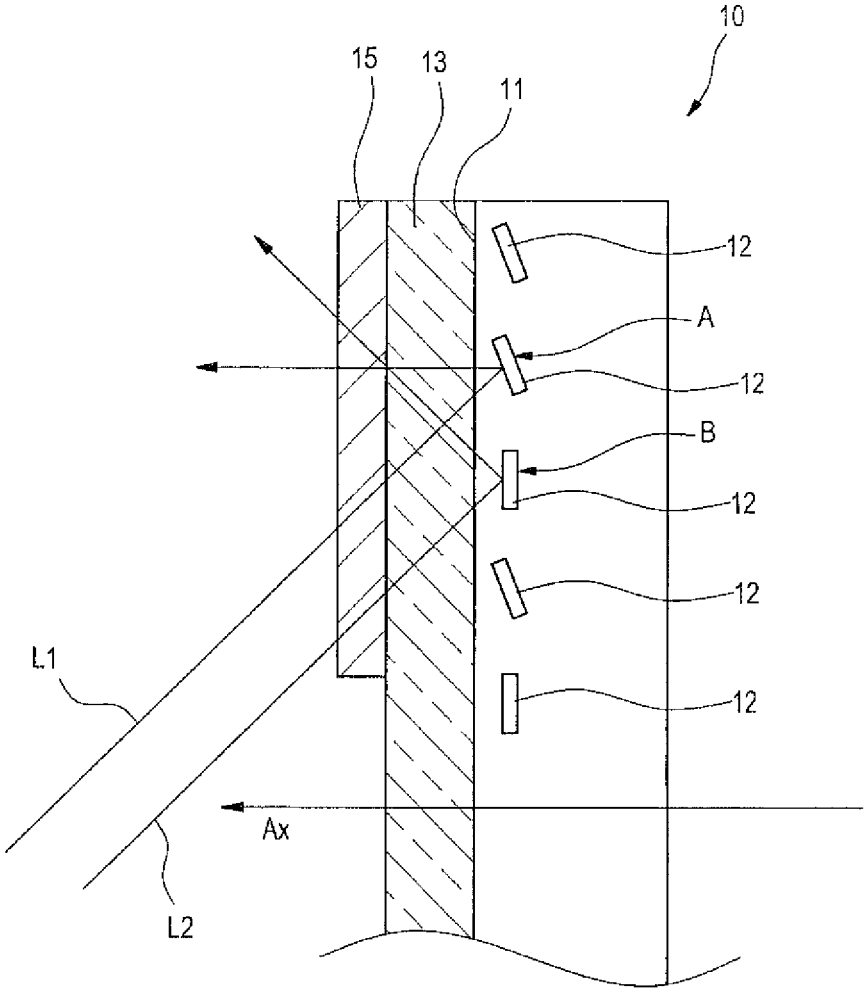
FIG. 3 is a partially enlarged view of DMD.

FIG. 3 shows an enlarged view of the DMD 10.

The DMD 10 is a device that is formed using an MEMS (Micro Electro Mechanical Systems) technology. The DMD 10 is a two-dimensional image forming device in which a plurality of reflective elements (which is an example of optical element) 12 are arranged on a single substrate in a matrix shape. By these reflective elements 12, the projection plane 11 for reflecting the light emitted from the LED 4 is formed on a front surface of the DMD 10. The DMD 10 is disposed on or in the vicinity of the rear focal point F of the projection lens 6.

Each of a plurality of reflective elements 12 is provided rotatably about its rotating axis. By applying voltage individually to each reflective element 12, each reflective element 12 can be individually switched between a state where the reflective element is stationary in a posture indicated by an arrow A and a state where the reflective element is stationary in a posture indicated by an arrow B.

When the reflective element 12 is in a posture indicated by the arrow A (i.e., in a posture where a reflective surface of the reflective element 12 forms an angle of about 45' with respect to the optical axis Ax), the light L1 incident on the reflective element 12 is reflected to be incident on the projection lens 6. Thereby, light from the LED 4 is emitted to the front of the lamp through the projection lens 6. The reflective element 12 is referred to be in an incident position when the reflective element 12 is in a posture where light from the LED 4 is allowed to be incident on the projection lens 6 as described above.

On the contrary, when the reflective element 12 is in a posture indicated by the arrow B (i.e., in a posture where a reflective surface of the reflective element 12 is substantially perpendicular to the optical axis Ax), the light L2 incident on the reflective element 12 is not incident on the projection lens 6 but reflected in a direction deviated from the projection lens 6. Thereby, light from the LED 4 is not emitted to the front of the lamp. The reflective element 12 is referred to be in a non-incident position when the reflective element 12 is in a posture where the light is not allowed to be incident on the projection lens 6 as described above.

The reflective elements 12 are driven individually by a control signal transmitted from a control unit 7 (see FIG. 1) and can be respectively switched between the incident position and the non-incident position. By switching each of the reflective elements 12 between the incident position and the non-incident position, it is possible to form a desired irradiation pattern on the projection plane 11.

Figure 4A:
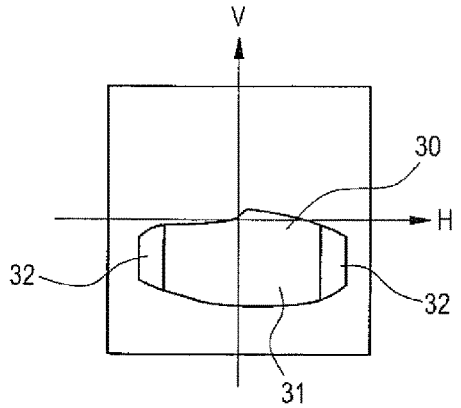
FIG. 4A is a view showing a light distribution pattern that is formed by the vehicular headlamp according to the present embodiment.
Figure 4B:
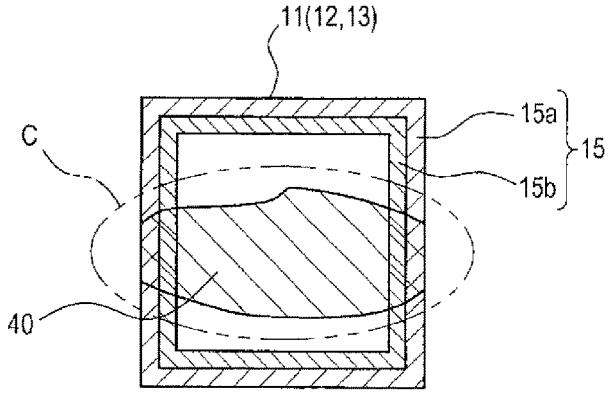
FIG. 4B is a view showing an irradiation pattern and a projection plane for forming the light distribution pattern of FIG. 4A
Figure 4C:
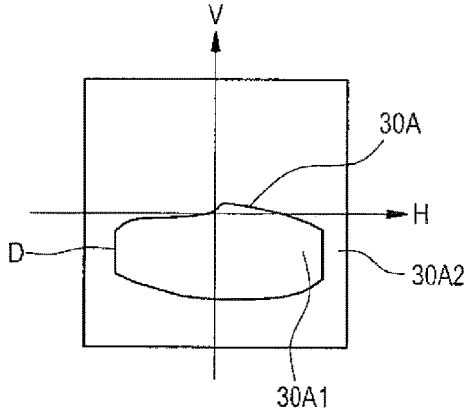
FIG. 4C is a view showing a light distribution pattern according to a comparative example.

In the vehicular headlamp 1 thus configured, an irradiation pattern 40 formed on the projection plane 11 is projected to the front of the lamp by the projection lens 6, thereby forming a light distribution pattern 30. Accordingly, in order to form the light distribution pattern (light distribution pattern for a low-beam) 30 as shown in FIG. 4A in front of the lamp, the irradiation pattern 40 as shown in FIG. 4B is formed on the projection plane 11. FIGS. 4A and 4C show light distribution patterns 30, 30A formed on a virtual vertical screen which is provided in the front of 25 m of the vehicular headlamp 1.

FIG. 4B shows an example of the irradiation pattern 40 to be formed on the projection plane 11. As indicated by reference numeral C, the range of the projection plane 11 larger than the irradiation pattern 40 in a shape approximating to the light distribution pattern 30 is irradiated with light from the LED 4. Furthermore, the reflective elements 12 belonging to a region of the irradiated range C corresponding to the shape of the light distribution pattern 30 are set on an incident position and the other reflective elements 12 are set on a non-incident position. In this way, by setting the reflective elements 12 belonging to a specific region on the incident position and setting the other reflective elements 12 on the non-incident position, the irradiation pattern 40 is formed on the projection plane 11. Here, the irradiation pattern 40 refers to a shape that is configured by a plurality of reflective elements 12 to be set on the incident position. Although the reflective elements 12 are not shown in FIG. 4B, it is preferable that ten thousands to one million of reflective elements 12 are formed on the projection plane 11.

Here, light from the LED 4 is irradiated toward the projection plane 11 while being spread to some extent. Accordingly, as shown in FIG. 4B, a portion of light from the LED 4 unintentionally is irradiated toward the outside of the projection plane 11.

Then, in a case where the dimming part 15 is not provided, in the ends of the left and right direction of the irradiation pattern 40, light from the LED 4 is reflected on the inside of the end boundary of the projection plane 11 and light from the LED 4 is not reflected on the outside of the end boundary of the projection plane 11. That is, as in the light distribution pattern 30A of a comparative example shown in FIG. 4C, a bright portion 30A1 that is brightly irradiated with reflection light from the reflective elements 12 is formed on the inside of the light distribution pattern 30A and a dark portion 30A2 that is not irradiated with light is formed on the outside of the light distribution pattern 30A, in the ends of the left and right direction of the light distribution pattern 30A. Accordingly, an extreme light-dark boundary line D is visually recognized at the contour of the light distribution pattern 30A and thus a user feels a sense of discomfort. Such a sense of discomfort is more noticeable when a light-dark boundary line of the light distribution pattern 30A appears as a linear shape, as illustrated.

Accordingly, in the present embodiment, the dimming part 15 is provided between the reflective elements 12 and the projection lens 6 and reduces light directed to the projection lens 6 from the reflective elements 12 arranged in the end portion of the projection plane 11. In the example shown in FIG. 4B, the dimming part 15 of a frame shape including an outermost periphery of the projection plane 11 is provided on the transparent cover 13. Since the dimming part 15 is provided in a site covering the reflective elements 12 disposed in the outermost periphery, it is possible to reduce light directed to the projection lens 6 from at least the reflective elements 12 disposed in the outermost periphery of the projection plane 11.

Such a dimming part 15 can be formed by printing ink of semi-translucency on a site of an upper surface of the transparent cover 13 that covers the reflective elements 12 to be dimmed, for example. Alternatively, the dimming part 15 can be configured by collection of fine dots that are obtained by printing ink of light shielding property on the transparent cover 13, or a semi-transparent tape affixed to the transparent cover 13, or the like.

Alternatively, the dimming part 15 may be configured by diffusing light so as not to be directed to the projection lens 6 as well as blocking a portion of light to be incident on the projection lens 6. In this case, the dimming part 15 may be configured by providing a diffusion prism at a site of an upper surface of the transparent cover 13 that covers the reflective elements 12 to be dimmed or forming fine irregularities on the upper surface of the transparent cover 13.

As such, according to the vehicular headlamp 10 of the present embodiment, light directed to the projection lens 6 from at least the reflective elements 12 positioned at an outermost periphery of the projection plane 11 is reduced by the dimming part 15. As a result, intensity of light in end portions 32 of the light distribution pattern 30 is weaker than that in a center portion 31 of the light distribution pattern 30 and therefore it is possible to blur a light-dark boundary line in the end portion of the light distribution pattern 30, thereby forming the light distribution pattern 30 having a natural visual performance.

As illustrated, the dimming part 15 may be formed in a frame shape having a predetermined width so that light from the reflective elements 12 located inside the reflective elements 12 positioned at the outermost periphery of the projection plane 11 can be also reduced together. In this case, it is preferable to form the dimming part 15 in such a way that an amount of dimming of light from the reflective elements 12 positioned at the central side of the projection plane 11 is smaller than that of light from the reflective elements 12 positioned at an outer periphery side of the projection plane 11.

Further, it is desirable to gradually reduce the light directed to the projection lens 6 over the reflective elements 12 arranged from the central side to the end portion side of the projection plane 11. In the present embodiment, the dimming part 15 includes a first dimming portion 15*a* covering at least the reflective elements 12 positioned at the outermost periphery of the projection plane 11 and a second dimming portion 15*b* provided inside the first dimming portion 15*a*. The second dimming portion 15*b* is formed in such a way that an amount of dimming of the second dimming portion becomes smaller than that of the first dimming part 15*a*. As a result, intensity of light is weakened step by step from an inner side toward an outer side of the light distribution pattern 30 and therefore it is possible to form the light distribution pattern 30 having a visual performance which is more natural to a user.

Further, the shape of the dimming part 15 is not limited to the frame shape shown in FIG. 4B. The dimming part 15 may be formed in order to block light directed to the projection lens 6 from at least some reflective elements 12 positioned at the outermost periphery of the projection plane 11. For example, as shown in FIG. 5A or 5B, the dimming part 15 may be formed in order to reduce light directed to the projection lens 6 from the reflective elements 12 positioned at both left and right end portions of the projection plane 11 as seen from the front of the lamp.

Figure 5A:
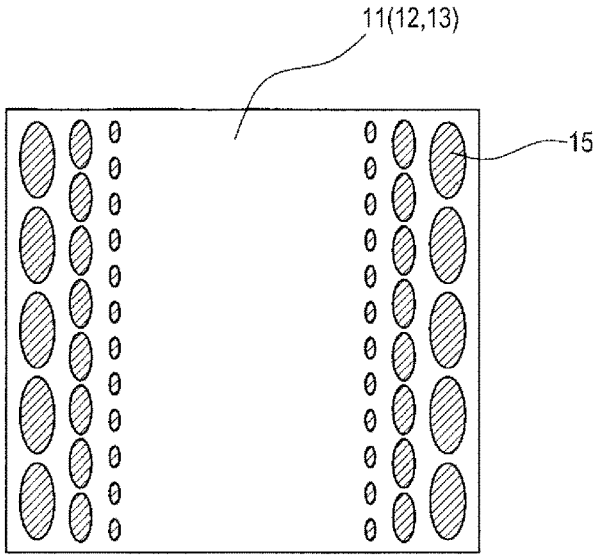
FIGS. 5A and 5B are views schematically showing a dimming part.

In FIG. 5A, the dimming part 15 is configured by a plurality of spots which are obtained by printing ink of semi-translucency in the vicinity of the left and right end portions of the projection plane 11. Each of these spots is formed in such a way that each spot is larger in the end portion side and becomes smaller toward the center. As a result, light from the reflective elements 12 disposed in an outer periphery side of the projection plane 11 is greatly blocked by the dimming part 15 and a blocked degree of light from the reflective elements 12 disposed in the center side is gradually reduced. Thereby, it is possible to form the light distribution pattern 30 having a natural visual performance, in which brightness is gradually lowered from the center toward the outside and thus the light-dark boundary line D is not conspicuous.

Figure 5B:
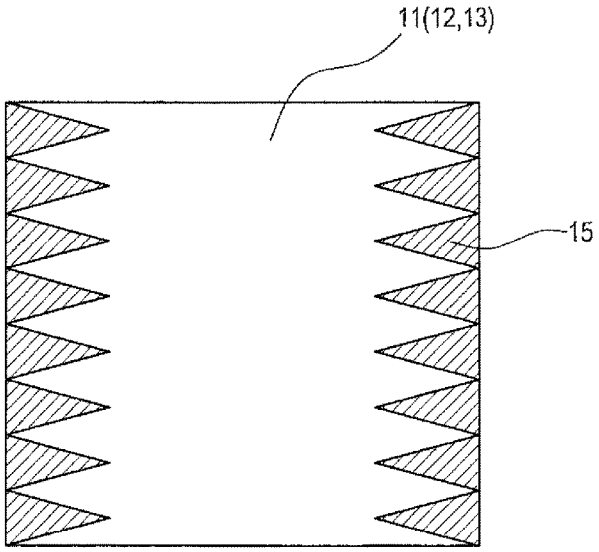

Further, as shown in FIG. 5B, ink of semi-translucency may be printed in a triangular shape protruding toward the central side from the end portion of the projection plane 11. According to this example, it is possible to achieve the same effects as in the dimming part 15 shown in FIG. 5A.

The dimming part 15 may not be provided on the transparent cover 13. On the path of light directed to the projection lens 6 from the reflective elements 12, the dimming part 15 may be configured by a member different from the transparent cover 13. For example, the dimming part 15 may be configured by providing a semi-transparent plate or a diffusion prism or the like on the path of light directed to the projection lens 6 from the reflective elements 12.

Figure 6A:
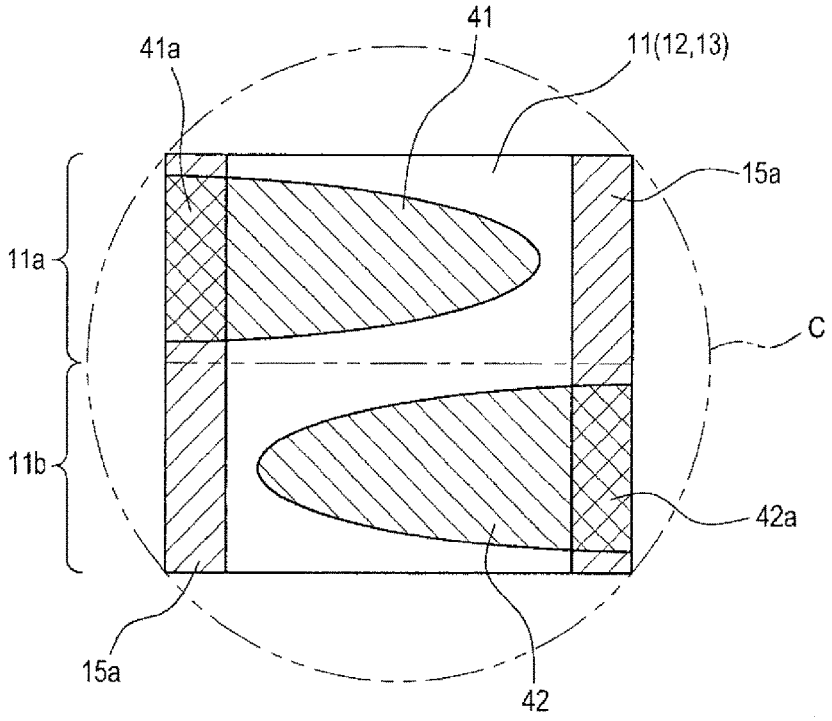
FIG. 6A is a view showing another example of the irradiation pattern and FIG. 6B is a view showing a light distribution pattern that is formed using the irradiation pattern of FIG. 6A.
Figure 6B:
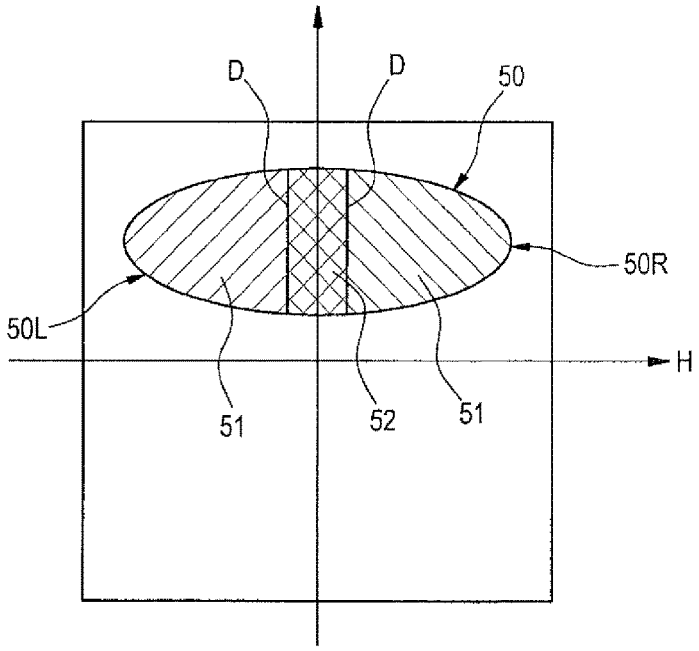

FIG. 6A shows irradiation patterns 41, 42 of another example to be formed on the projection plane 11. Further, FIG. 6B shows a light distribution pattern (light distribution pattern for a high beam) 50 which is formed by the irradiation patterns 41, 42 shown in FIG. 6A.

In the example shown in FIG. 6A, the range C of light to be incident on the projection plane 11 from the LED 4 is adapted to cover substantially entire surface of the projection plane 11 in order to be able to make effective use of the projection plane 11. Further, the projection plane 11 is divided into two projection regions 11*a*, 11*b* of the upper and lower. Here, an irradiation pattern 41 forming the right side 50R of the light distribution pattern 50 is formed in an upper projection region 11*a* and an irradiation pattern 42 forming the left side 50L of the light distribution pattern 50 is formed in a lower projection region 11*b*. The projection lens 6 projects the irradiation patterns 41, 42 forward so as to be continuous in the left and right direction. As a result, the light distribution pattern 50 that is long in the left and right direction as shown in FIG. 6B is formed. At this time, the end portions 41*a*, 41*b* of the irradiation patterns 41, 42 are projected in a state of being overlapped with each other.

Here, in a case where the dimming part is not provided, a light-dark boundary line is conspicuous when the light distribution pattern is formed by overlapping the end portions of the irradiation patterns. That is, when intensity of light to be irradiated by each irradiation pattern 41, 42 is defined as 100, illuminance is 200 in a central region 52 of the light distribution pattern in which the irradiation patterns 41, 42 are overlapped. Further, in an outer region 51 of the left and right of the light distribution pattern, the irradiation patterns are not overlapped and therefore illuminance is 100. As a result, a light-dark boundary line D formed at a boundary between the region 52 of illuminance 200 and the region 51 of illuminance 100 is conspicuous.

However, according to the vehicular headlamp 1 of the present embodiment, illuminance in the end portions 41*a*, 42*a* of the irradiation patterns 41, 42 is reduced by the dimming part 15, even when the light distribution pattern 50 is formed by overlapping the irradiation patterns 41, 42. For this reason, brightness of the overlapped portion 52 is not twice brightness of the region 51 that is not overlapped. In this way, it is possible to allow the light-dark boundary line D to be inconspicuous.

More preferably, an amount of dimming of the dimming part 15 is set so that brightness is varied linearly from a bright region toward a dark region. As a result, in a central region 52 of the light distribution pattern 50, light with illuminance 50 is overlapped and therefore illuminance 100 is obtained. Also in an outer region 51 of the left and right of the light distribution pattern 50, illuminance 100 is obtained. Thereby, it is possible to form a light distribution pattern in which a light-dark boundary line D is not formed and which has an extremely natural visual performance.

Figure 7:
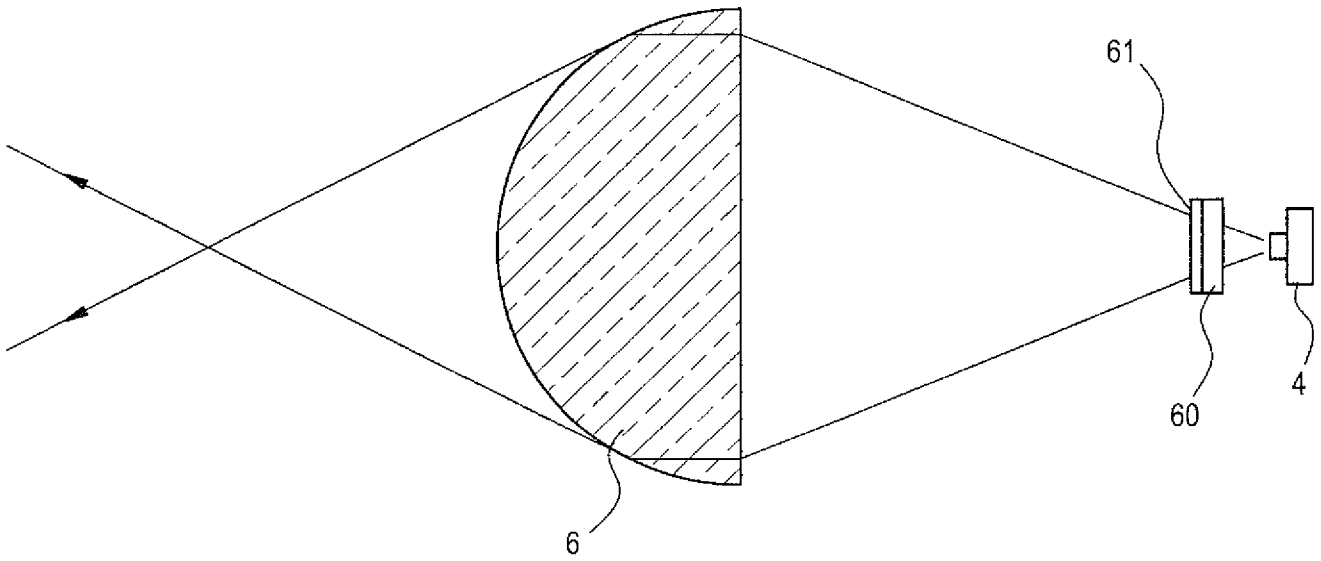
FIG. 7 is a view showing a vehicular headlamp according to another exemplary embodiment, corresponding to FIG. 2.

Although the DMD 10 is used as a two-dimensional image forming device in the above-described embodiment, the present invention is not limited to this configuration. For example, a liquid crystal device may be used as a two-dimensional image forming device. FIG. 7 shows the members in an interior of the lamp chamber S when a liquid crystal device 60 is used as a two-dimensional image forming device.

In the interior of the lamp chamber S, the LED 4, the liquid crystal device 60 and the projection lens 6 are arranged in order from the rear in a direction of the optical axis Ax. A projection plane 61 through which light from the LED 4 can be transmitted is formed on a front side surface (a projection lens 6 side) of the liquid crystal device 60. An irradiation pattern formed on the projection plane 61 of the liquid crystal device 60 is projected forward by the projection lens 6, in a state of being vertically and horizontally inverted and enlarged.

Figure 8:
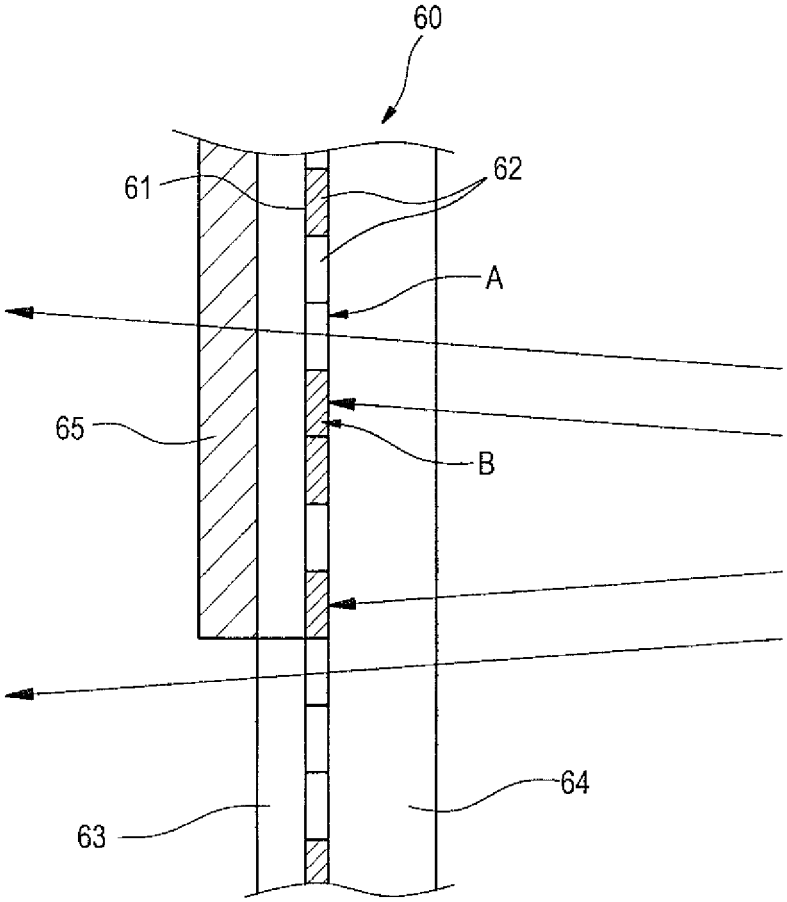
FIG. 8 is a partially enlarged view of a liquid crystal device.

FIG. 8 shows an enlarged view of the liquid crystal device 60.

A plurality of liquid crystal elements (optical elements) 62 are arranged on the projection plane 61 of the liquid crystal device 60 in a matrix shape. The projection plane 61 through which light from the LED 4 is transmitted is formed by these liquid crystal elements 62. Further, a glass cover (transparent cover) 63 for protecting the liquid crystal elements 62 is attached to the projection plane 61. The liquid crystal elements 62 are separately enclosed between the glass cover 63 and a transparent electrode 64 in a matrix shape.

The liquid crystal elements 62 can be individually switched between a transmissive state (a state indicated by an arrow A) where light from the LED 4 is transmitted through the liquid crystal elements and allowed to be incident on the projection lens 6 and a non-transmissive state (a state indicated by an arrow B) where light from the LED 4 is blocked by the liquid crystal elements and not allowed to be incident on the projection lens 6. By switching each of the liquid crystal elements 62 between the transmissive state and the non-transmissive state, it is possible to form a desired irradiation pattern on the projection plane 61.

A dimming part 65 is provided at a site of the glass cover 63 that covers at least the liquid crystal elements 62 arranged on an end portion of the projection plane 61 and diminishes the light directed to the projection lens 6 from the liquid crystal elements 62 arranged on the end portion of the projection plane 61.

Even in a case where the liquid crystal device 60 is used as a two-dimensional image forming device as described above, it is possible to reduce the amount of light incident toward the projection lens 6 from the liquid crystal elements 62 arranged in a peripheral portion of the projection plane 61 by providing the dimming part 65 in a peripheral portion of the glass cover 63. As a result, it is possible to form a light distribution pattern having a natural visual performance, in which intensity of light is gradually attenuated toward an outer periphery thereof and thus a light-dark boundary line is not conspicuous, in an end portion of a light distribution pattern to be projected from the projection lens 6.

Although an example where the present invention is applied to a vehicular headlamp has been described in the above description, the present invention is not limited to this configuration. For example, the present invention may be applied to a vehicular signaling lamp or the like. Further, although an example where LED is employed as a light source has been described, an organic EL or discharge bulb or the like may be employed as the light source. In addition, although a light distribution pattern for a low beam and a light distribution pattern for a high beam have been described as an example of the light distribution pattern to be formed, the present invention is not limited to these light distribution patterns.

What is claimed is:

1. A vehicular lamp comprising:

a projection lens;

a two-dimensional image forming device located on a rear focal point of the projection lens, and including a plurality optical elements which are arranged in a matrix shape and individually driven and a projection plane that is formed by the plurality optical elements;

a light source configured to irradiate the projection plane of the two-dimensional image forming device with light; and a dimming part provided between the optical elements and the projection lens and configured to reduce light directed to the projection lens from the optical elements arranged on an end portion of the projection plane, wherein the dimming part gradually reduces the light directed to the projection lens over the optical elements arranged from the central side to the end portion side of the projection plane.

2. The vehicular lamp according to claim 1, further comprising:

a transparent cover provided between the optical elements and the projection lens, wherein the dimming part is provided in an end portion of the transparent cover.

3. The vehicular lamp according to claim 1, wherein the dimming part reduces light directed to the projection lens by blocking a portion of light directed to the projection lens from the optical elements.

4. The vehicular lamp according to claim 1, wherein the dimming part reduces light directed to the projection lens by diffusing a portion of light directed to the projection lens from the optical elements.

* * * * *